US008523584B2

(12) United States Patent
Ton

(10) Patent No.: US 8,523,584 B2
(45) Date of Patent: Sep. 3, 2013

(54) WEB MEMBRANE CONNECTOR SEAL

(75) Inventor: Jack Ton, North Reading, MA (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 13/278,590

(22) Filed: Oct. 21, 2011

(65) Prior Publication Data

US 2012/0100739 A1 Apr. 26, 2012

Related U.S. Application Data

(60) Provisional application No. 61/405,270, filed on Oct. 21, 2010.

(51) Int. Cl.
*H01R 13/52* (2006.01)

(52) U.S. Cl.
USPC ..... 439/204

(58) Field of Classification Search
USPC ..... 439/204, 487, 936, 489, 521, 278; 174/76
See application file for complete search history.

(56) References Cited

U.S. PATENT DOCUMENTS

| | | | | |
|---|---|---|---|---|
| 3,336,569 | A | 8/1967 | Nava | |
| 3,512,119 | A | 5/1970 | Cameron | |
| 3,755,615 | A * | 8/1973 | Paullus et al. | 174/76 |
| 3,772,637 | A * | 11/1973 | Paullus et al. | 439/589 |
| 3,786,396 | A | 1/1974 | Kemmer et al. | |
| 3,835,442 | A * | 9/1974 | Anderson et al. | 439/86 |
| 3,960,428 | A | 6/1976 | Naus et al. | |
| 3,972,581 | A * | 8/1976 | Oldham | 439/201 |
| 4,029,105 | A * | 6/1977 | Faust | 128/207.17 |
| 4,083,902 | A * | 4/1978 | Clyde | 264/420 |
| 4,425,017 | A * | 1/1984 | Chan | 439/276 |
| 4,629,269 | A | 12/1986 | Kailus | |
| 5,140,746 | A * | 8/1992 | Debbaut | 29/855 |
| 5,228,970 | A * | 7/1993 | Foley | 204/616 |
| 5,401,927 | A * | 3/1995 | Lundell et al. | 200/314 |
| 5,429,697 | A * | 7/1995 | Lilienthal et al. | 156/244.19 |
| 5,490,803 | A * | 2/1996 | McMills et al. | 439/276 |
| 5,588,856 | A * | 12/1996 | Collins et al. | 439/204 |
| 6,227,900 | B1 * | 5/2001 | Heise | 439/426 |
| 6,235,862 | B1 * | 5/2001 | Isshiki et al. | 528/15 |
| 6,244,897 | B1 * | 6/2001 | Shinozaki | 439/587 |
| 6,360,438 | B1 * | 3/2002 | Gladd et al. | 29/883 |
| 6,364,692 | B1 * | 4/2002 | Okayasu et al. | 439/426 |
| 6,500,027 | B1 * | 12/2002 | Van Der Sanden et al. | 439/587 |
| 7,153,150 | B2 * | 12/2006 | Atsumi et al. | 439/204 |
| 8,113,860 | B2 * | 2/2012 | Sandwith | 439/271 |
| 2005/0191899 | A1 * | 9/2005 | Solano | 439/519 |

* cited by examiner

*Primary Examiner* — Neil Abrams
*Assistant Examiner* — Travis Chambers
(74) *Attorney, Agent, or Firm* — Blank Rome LLP

(57) ABSTRACT

A connector includes a connector body having cavities with through-holes disposed therein. Sealing membranes are received in the cavities and serve to protect the connector from the environment. Wire conductors may pierce the sealing membranes, and may be received by the through-holes of the cavities in the connector. In cavities in which wire conductors have been received, each sealing membrane forms a seal around a corresponding wire conductor. The connector body is formed from a first material, and the sealing membranes are formed from a second material, different from the first material.

22 Claims, 5 Drawing Sheets

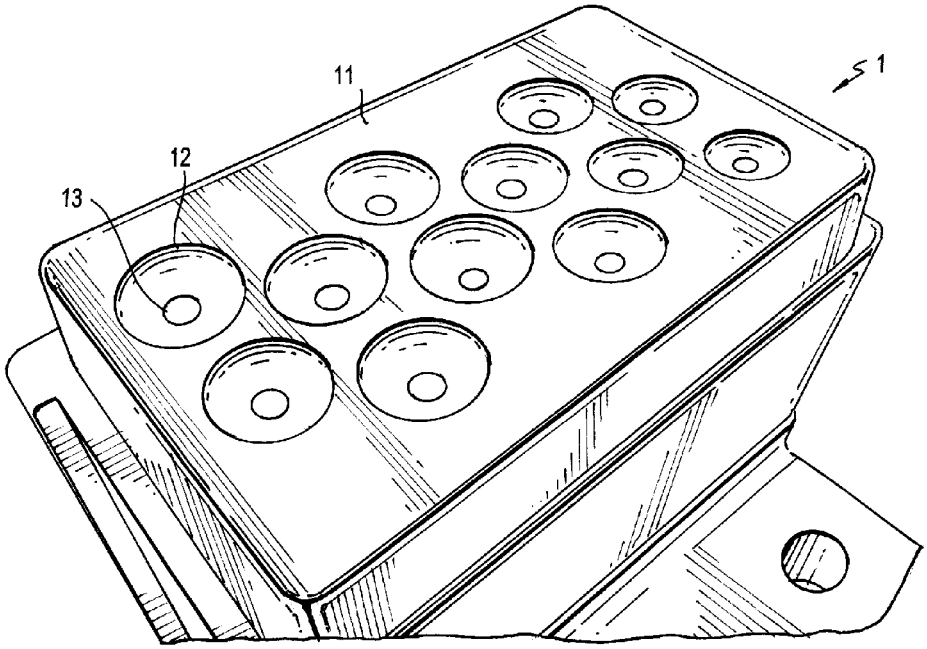
FIG. 3
(PRIOR ART)
FIG. 4
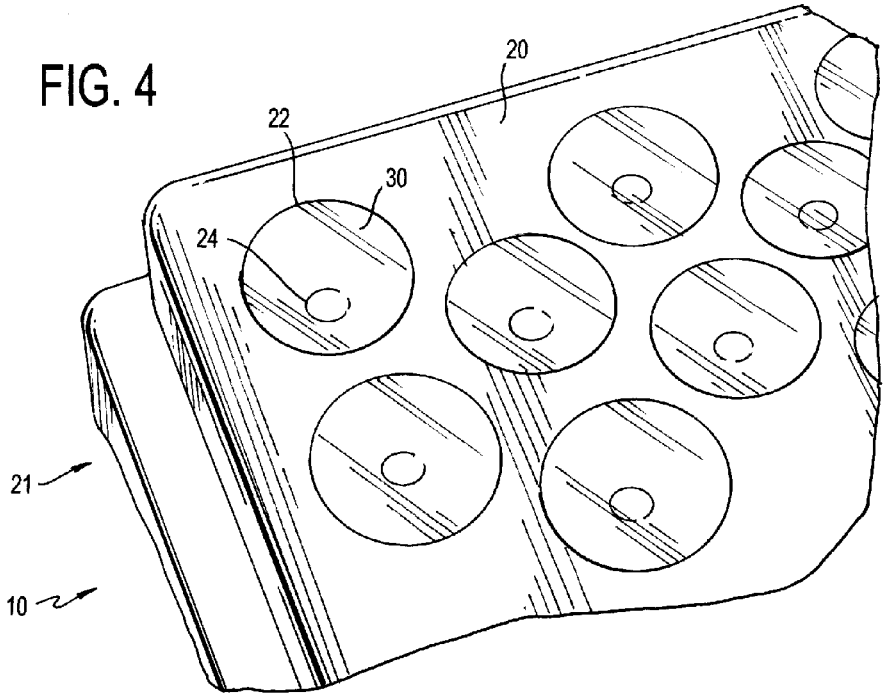

WEB MEMBRANE CONNECTOR SEAL

CROSS REFERENCE TO RELATED APPLICATIONS

This patent application claims the benefit of U.S. Provisional Patent Application No. 61/405,270 filed Oct. 21, 2010, the entirety of which is incorporated herein by reference.

BACKGROUND OF THE INVENTION

1. Field of the Invention

The present invention relates to an electrical connector. In particular, the present invention relates to an electrical connector having an improved means for sealing the connector from the environment, and a method for forming such a connector.

2. Background of the Related Art

Turning first to FIGS. 1-3, shown therein is a conventional connector 1 for use in harsh environments. Traditional connectors 1 and modules include M38999, M81714, M12883, and M5105 connectors, and the like. The connector 1 is built with a wire sealing grommet 11 made of silicone. The grommet 11 includes cavities 12 having holes 13, the holes 13 configured to accept wires 14 inserted therethrough. The holes 13 in the grommet 11 have a diameter that is typically less than the diameter of the wires 14 so that, upon insertion of a wire 14 into the connector 1 through a hole 13, a tight seal is created between the wire 14 and the grommet 11. As shown in FIG. 2, when holes 13 do not have wires 14 inserted therethrough, separate plastic sealing plugs 15 are used to prevent moisture and debris from entering the cavities 12 and potentially damaging the connector 1. The sealing plugs 15 come in various sizes, which depend on the diameter of the cavities 12. Installing these sealing plugs 15 is time consuming. The sealing plugs 15 add weight to the connector 1, which is undesirable. Furthermore, the sealing plugs 15 have a potential to fall out of the connector 1, making the protection offered by the sealing plugs 15 unreliable. FIG. 3 is a more detailed view of the grommet 11 having unfilled contact cavities 12.

U.S. Pat. No. 4,629,269 to Kailus, the entirety of which is incorporated herein by reference, describes a connector insert having pockets that are sealed by a membrane, which is molded integral with the insert. Because the membrane described in that patent is integral with the insert, the membrane necessarily must be made of the same material as the insert. However, the material used for the insert may not be optimal for use as a membrane. Similarly, the material that may be optimal for use as a membrane is not necessarily appropriate for use as a connector insert. Consequently, the membrane may shear when a wire or connector is inserted through it, and pieces of the membrane may interfere with the operation of the connector. In addition, the color of the material used for the insert may not be optimal for use as a membrane, and vice versa.

Accordingly, there exists a need to provide a lightweight electrical connector for use with a selectable number of wires, and a method of forming the same, in which the connector is protected against potential damage caused by moisture or other harmful substances in the environment, in which the disadvantages associated with the use of sealing plugs is avoided, and in which the types of materials used to form the sealing membranes and other connector components may be optimized depending on the application for which the connector is desired.

SUMMARY OF THE INVENTION

Accordingly, it is an object of the present invention to provide an electrical connector in which the number of wires received by the connector is selectable.

It is another object of the present invention to provide an electrical connector in which the connector is protected from the environment.

It is yet another object of the present invention to provide an electrical connector that overcomes the disadvantages of the use of sealing plugs, including increased connector weight, increased installation time, and unreliable protection.

It is yet another object of the present invention to provide an electrical connector in which the type of material used to form the connector body and the type of material used to seal the connector from the environment may be optimized.

Those and other objects of the present invention are accomplished, as embodied and fully described herein, by a connector, and a method for comprising the same, the connector comprising: a connector body having a surface, said connector body comprising a first material; at least one cavity formed in the surface of the connector body; and a sealing membrane received in the at least one cavity, said sealing membrane comprising a second material different from the first material.

The connector of the present invention may be configured to receive a wire conductor that pierces the sealing membrane, and the sealing membrane may form a seal around the wire conductor without shearing off when pierced by the wire conductor. The sealing membrane may adhere to the cavity, and may be formed separately from the connector body.

With those and other objects, advantages, and features of the invention that may become hereinafter apparent, the nature of the invention may be more clearly understood by reference to the following detailed description of the invention, the appended claims, and the several drawings attached herein.

BRIEF DESCRIPTION OF THE DRAWINGS

FIG. 3 is a detailed view of the conventional connector depicted in FIG. 1.

FIG. 4 is a perspective view of a connector in accordance with the present invention, the connector having cavities with sealing membranes received therein.

DETAILED DESCRIPTION OF THE PREFERRED EMBODIMENTS

Figure 2:
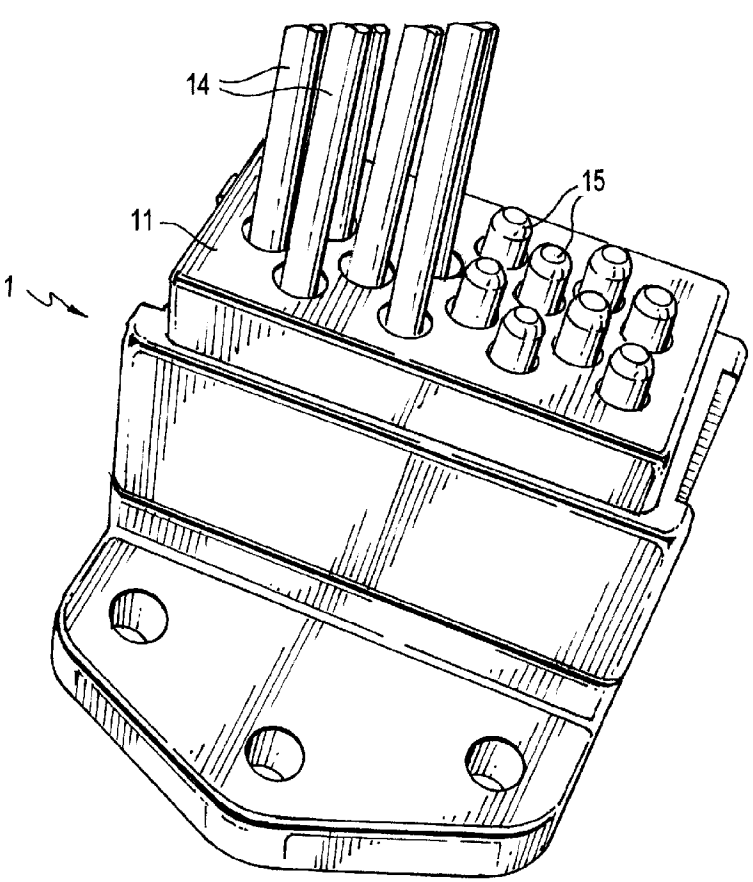
FIG. 2 (PRIOR ART)
FIG. 2 is a perspective view of a conventional connector having wire conductors and sealing plugs received therein.
Figure 1:
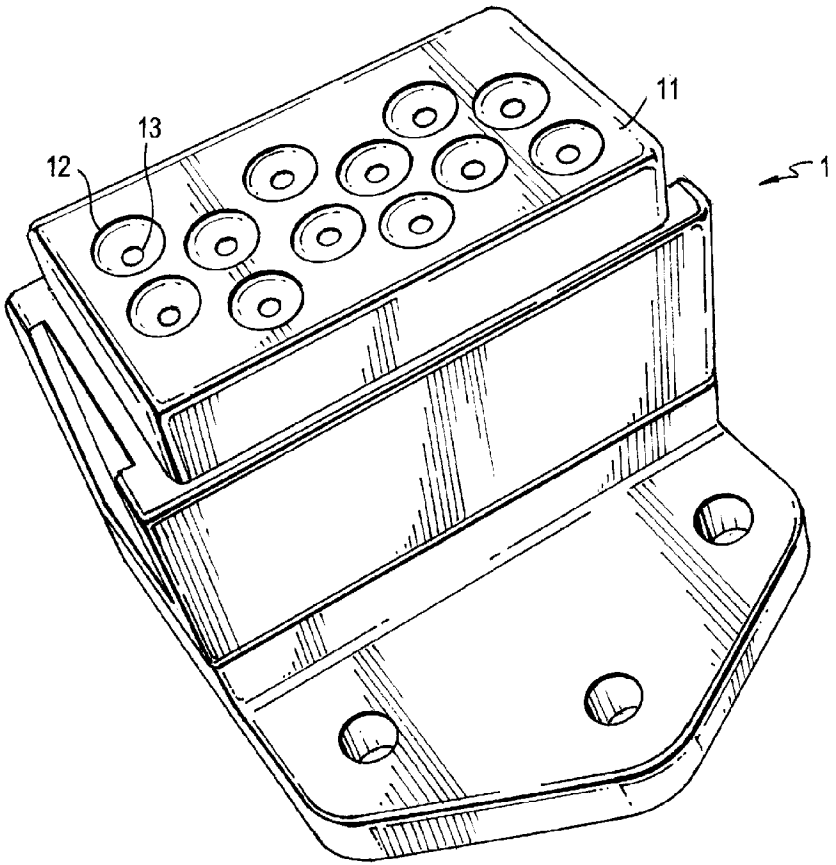
FIG. 1 (PRIOR ART)
FIG. 1 is a perspective view of a conventional connector.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents that operate in similar manner to accomplish a similar purpose. It is further understood that the invention may be embodied in other forms not specifically shown in the drawings.

Turning to FIG. 4, shown therein is a connector 10 having a grommet 20 in accordance with the preferred embodiment. The grommet 20 is part of the connector body 21, and may be formed separately from, or integrally with, the connector body 21. The grommet 20 has a number of cavities 22 positioned about the surface of the grommet 20. A central through-hole 24 is positioned at the center of each of the cavities 22. Each through-hole 24 extends through the grommet 20. A silicone membrane 30 is received in each of the cavities 22.

Figure 5:
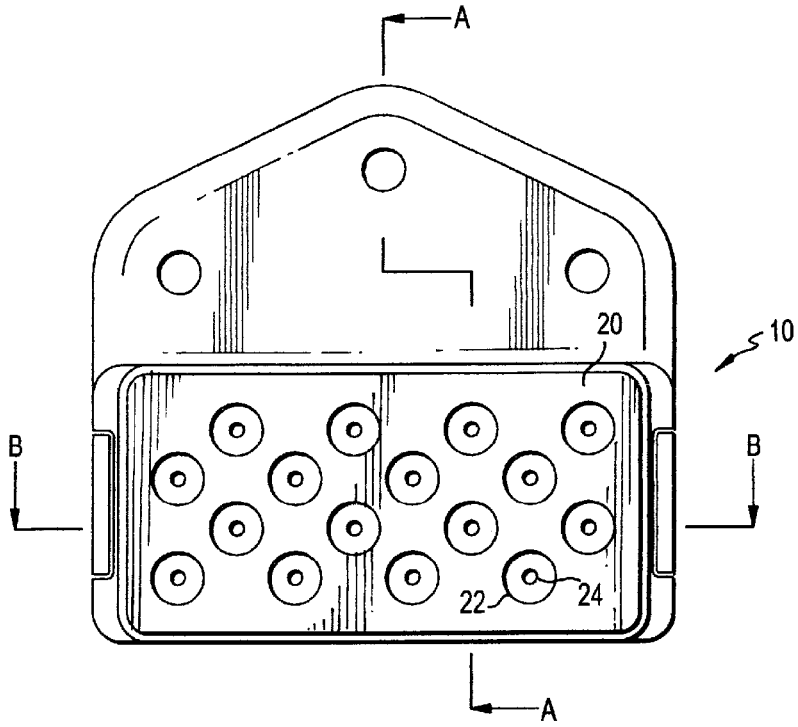
FIG. 5 is a top plan view of a connector in accordance with the present invention.

FIG. 5 is a top plan view of the grommet 20 showing the cavities 22 and through-holes 24. The number and position of the cavities 22 shown in FIG. 5 is exemplary only, and more or fewer cavities 22 may be provided. In the preferred embodiment shown in FIG. 5, the cavities 22 are circular. However, in other embodiments, the cavities 22 may have different shapes and sizes.

Figure 6:
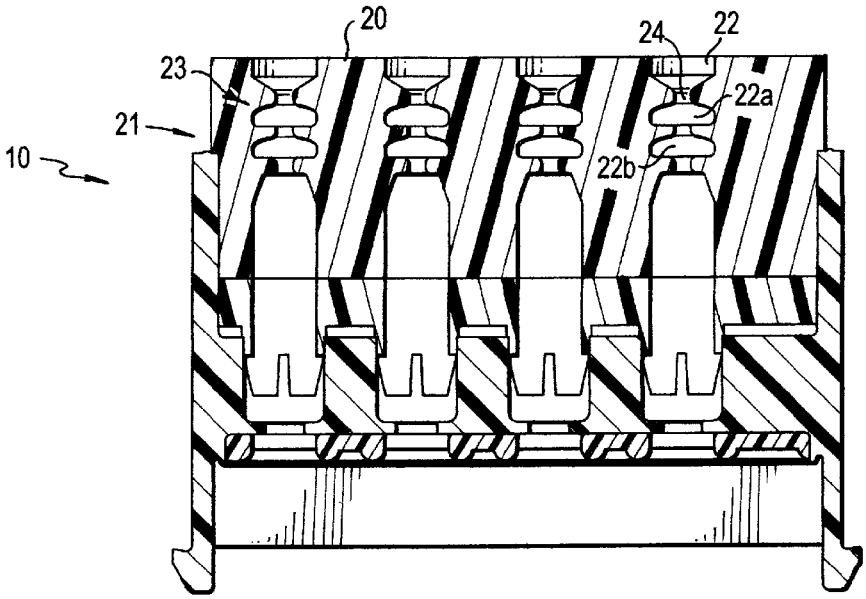
FIG. 6 is a cross-sectional view of the connector depicted in FIG. 5.
Figure 7:
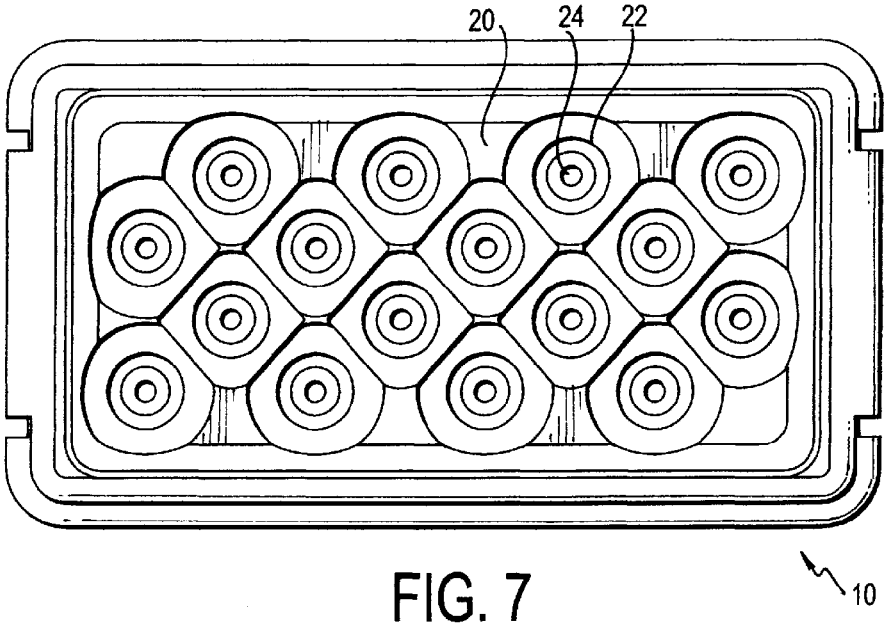
FIG. 7 is a top plan view of a connector in accordance with the present invention.

FIG. 6 is a cross-sectional view of the grommet 20 taken along line B-B of FIG. 5, before the silicon membrane 30 is inserted into the cavities 22. FIG. 7 is a top view of the grommet, showing the cavities 22 and through-holes 24.

Figure 8:
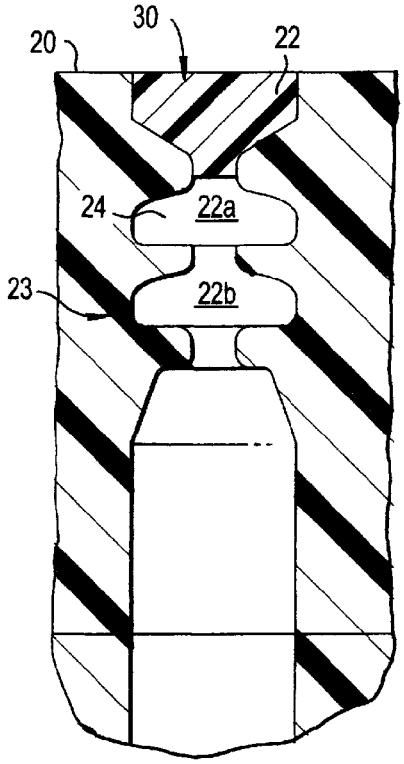
FIG. 8 is a cross sectional view of a through-hole and a cavity in accordance with the present invention.
Figure 9:
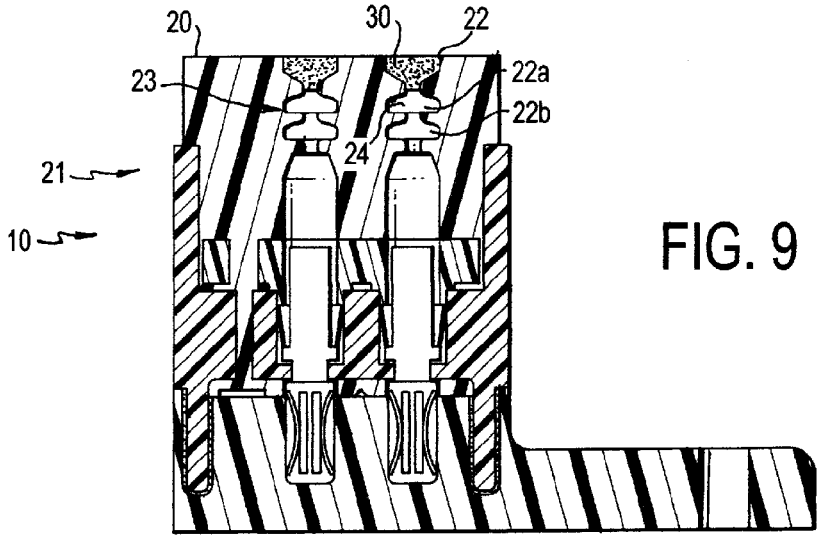
FIG. 9 is a cross-sectional view of the connector depicted in FIG. 5.
Figure 10:
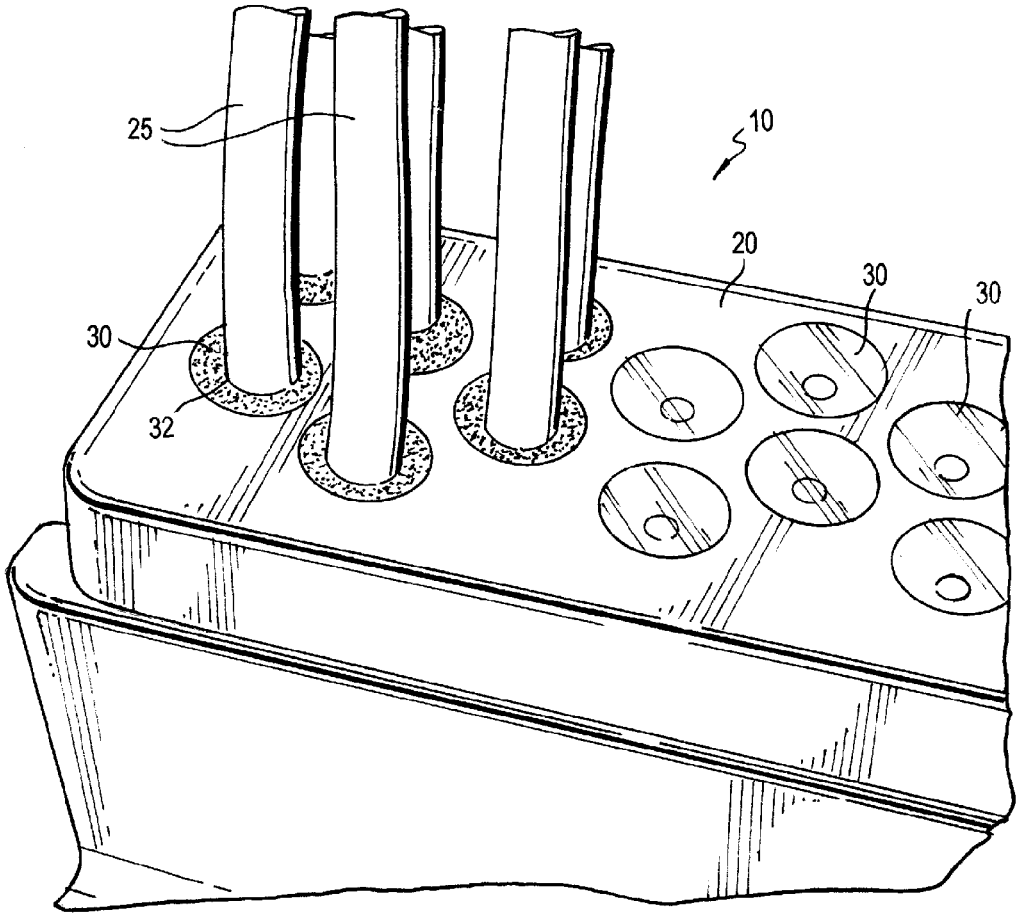
FIG. 10 is a perspective view of a connector in accordance with the present invention, the connector having cavities with sealing membranes received therein, and wire conductors that pierce the sealing membranes.

FIG. 8 is a cross-sectional view showing a through-hole 24 and a cavity 22, and FIG. 9 is a cross-sectional view taken along line A-A of FIG. 5. As shown in FIGS. 6, 8, and 9, the grommet 20 has a 3-riser seal 23, which has three small cavities 22, 22*a*, 22*b*. An electrical wire conductor 25, as shown in FIG. 10, extends through the 3-riser seal 23, and the 3-riser seal 23 forms a seal around the wire conductor 25. In the embodiment shown in the figures, the membrane 30 substantially fills the topmost cavity 22, which is located at the surface of the grommet 20. Accordingly, the membrane 30 is directly accessible at the surface of the grommet 20. The membrane 30 material is selected to fill the top cavity 22, but not pass through the through-hole 24 into the lower cavities 22*a*, 22*b*.

Turning to FIG. 10, insulated wire conductors 25 are shown positioned in the cavities 22. When a wire conductor 25 is inserted into the grommet 20, the wire conductor 25 pierces the membrane 30 to form an opening 32 in the membrane 30. The wire conductor 25 then passes through the lower cavities 22*a*, 22*b* of the 3-riser seal 23 to mechanically and electrically connect with the connector 10. Preferably, the wire conductor 25 connects to a contact within the connector 10. The membrane 30 adheres to the outside surface of the wire conductor 25 and forms a seal around the wire conductor 25 about the opening 32.

The formation of the membrane 30, and the receipt of the membrane 30 in the cavity 22, will now be explained. The membrane 30 is added to the cavity 22 after the grommet 20 is formed. The membrane 30 is therefore a separate element that is added to an existing grommet 20. The membrane 30 is initially in the form of a liquid, which is placed into each of the cavities 22 of the grommet 20 by using a syringe or other dispensing device. The liquid substantially fills the entirety of each cavity 22, but the viscosity and surface tension of the liquid prevent the liquid from extending beyond the top of each cavity 22. Once in place, the membrane 30 substantially cures within an hour, and fully cures within about 72 hours. The membrane 30 forms an air tight seal of the cavity 22 and the interior of the grommet 20. Preferably, a membrane 30 is formed over all of the cavities 22 of the grommet 20, whether or not it is know whether a particular cavity 30 will receive a wire contact 25.

In accordance with the preferred embodiment, the membrane 30 is a self-leveling silicone adhesive coating which adheres to a plastic grommet 20. The membrane 30 is relatively viscous, with a preferred viscosity of about 30,000-40,000 cps. The membrane 30 is relatively soft, with a preferred hardness of about 25 durometer, shore A. The membrane 30 is sufficiently flexible to form a seal about the wire conductor 25, yet also allow the wire conductor 25 to pierce the membrane 30 without having pieces of the membrane 30 shear off into the connector 10. The wire conductors 25 easily penetrate the membrane 30, and the membrane 30 provides a consistent puncture, irrespective of the material and properties of the grommet 20. Accordingly, the membrane 30 material can be optimized for its purpose of providing an air tight or fluid tight seal which can be punctured without shearing. And, the grommet 20 material can be separately optimized for its purpose for any given application, which may vary substantially from the purpose of the membrane 30.

The membrane 30 is also preferably translucent, so that it is easily visible when it is located in the cavity 22. Because the membrane 30 is clear, the user is able to see the cavity 22 and the through-hole 24, so that the wire conductor 25 may be easily positioned over and inserted into the through-hole 24. An example of the silicone appropriate for use as the membrane 30 is offered by Silicone Solutions of Twinsburg, Ohio, product number SS-6001.

The invention includes a process in which a clear silicone membrane 30 is adhered to a wire sealing grommet 20 to plug some, or preferably all, contact cavities 22 of a grommet 20. The membrane 30 is punctured when a wire conductor 25 with crimped contacts at its ends is inserted into the connector 10. If the contact cavities 22 are not occupied by wire conductors 25, then those cavities 22 remain sealed, so that sealing plugs 15 are not needed. The application of the membrane 30 can be incorporated into all connectors 10 with wire sealing grommets 20. The step of sealing the cavities 22 is separate from the formation of the connector body 21 and/or the grommet 20. Accordingly, the type of material used to form the connector body 21 and/or the grommet 20 and the membrane 30 may each be optimized for the particular application for which the connector 10 is desired. Additional, advantages of the present invention include that the connector 10 does not require sealing plugs 15, the connector 10 is light weight, the membranes 30 prevent the entry of foreign object debris into the connector 10, and the added installation time required to install sealing plugs 15 in the connector 10 is eliminated.

In the embodiment shown in FIGS. 4-10, the grommet 20 has a length of about 1.0 inches, a width of about 0.6 inches, and a thickness of about 0.3 inches. The cavities 22 each have a diameter of about 0.1 inches, and the through-holes 24 each have a diameter of about 0.03 inches. The connector 10, therefore, may receive wire conductors 25 having diameters ranging from about 0.03 inches to 0.1 inches. These dimensions are provided for exemplary purposes only, and are not intended to limit the scope of the invention. In the preferred embodiment, the connector 10 includes a grommet 20 as discussed above. However, other types of connectors and devices may be used without departing from the scope of the invention.

The foregoing description and drawings should be considered as illustrative only of the principles of the invention. The invention may be configured in a variety of shapes and sizes and is not intended to be limited by the preferred embodiment. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. A connector comprising:

a connector body having a grommet with a surface; and at least one topmost cavity formed at the surface of the grommet, wherein the topmost cavity has a through-hole positioned therein, the through-hole extending through the grommet, wherein the topmost cavity has a sealing membrane received therein such that the sealing membrane substantially fills the topmost cavity but does not pass through the through-hole, wherein the connector body comprises a first material, and wherein the sealing membrane comprises a second material different from the first material.

2. The connector of claim 1, wherein the sealing membrane adheres to the topmost cavity, and is not formed integrally with the connector body.

3. The connector of claim 1, wherein the sealing membrane is formed of a self-leveling silicone adhesive coating.

4. The connector of claim 1, wherein the sealing membrane has a viscosity of about 30,000 to 40,000 cps.

5. The connector of claim 1, wherein the sealing membrane has a hardness of about 25 durometer, shore A.

6. The connector of claim 1, wherein the sealing membrane is translucent.

7. The connector of claim 1 further comprising at least one lower cavity positioned beneath the topmost cavity.

8. The connector of claim 1, wherein the topmost cavity receives a wire conductor which pierces the sealing membrane.

9. The connector of claim 8, wherein the sealing membrane forms a seal around the wire conductor.

10. The connector of claim 8, wherein the sealing membrane does not shear off when pierced by the wire conductor.

11. The connector of claim 8 further comprising at least one lower cavity positioned beneath the topmost cavity, wherein the wire conductor extends through the at least one lower cavity, and wherein the at least one lower cavity forms a seal around the wire conductor.

12. A method for forming a connector, comprising the steps of:

providing a connector body having a grommet with a surface, the surface having at least one topmost cavity formed therein, the topmost cavity having a through-hole positioned therein, and the through-hole extending through the grommet; and forming a sealing membrane in the topmost cavity such that the sealing membrane substantially fills the topmost cavity but does not pass through the through-hole, wherein the connector body comprises a first material, and the sealing membrane is formed by a second material different from the first material.

13. The method of claim 12, wherein the sealing membrane has a hardness of about 25 durometer, shore A.

14. The method of claim 12, wherein the sealing membrane is translucent.

15. The method of claim 12, wherein the connector body comprises at least one lower cavity positioned beneath the topmost cavity.

16. The method of claim 12 further comprising the step of piercing the sealing membrane by inserting a wire conductor into the topmost cavity.

17. The method of claim 16, wherein the sealing membrane forms a seal around the wire conductor.

18. The method of claim 16, wherein the sealing membrane does not shear off when pierced by the wire conductor.

19. The method of claim 16 wherein the connector body comprises at least one lower cavity positioned beneath the topmost cavity, wherein the wire conductor extends through the at least one lower cavity, and wherein the at least one lower cavity forms a seal around the wire conductor.

20. A method for forming a connector, comprising the steps of:

providing a connector body having a grommet with a surface, the surface having at least one topmost cavity formed therein, the topmost cavity having a through-hole positioned therein, and the through-hole extending through the grommet; and forming a sealing membrane in the topmost cavity such that the sealing membrane substantially fills the topmost cavity but does not pass through the through-hole, wherein the sealing membrane adheres to the topmost cavity, and is not formed integrally with the connector body.

21. A method for forming a connector, comprising the steps of:

providing a connector body having a grommet with a surface, the surface having at least one topmost cavity formed therein, the topmost cavity having a through-hole positioned therein, and the through-hole extending through the grommet; and forming a sealing membrane in the topmost cavity such that the sealing membrane substantially fills the topmost cavity but does not pass through the through-hole, wherein the sealing membrane is formed of a self-leveling silicone adhesive coating.

22. A method for forming a connector, comprising the steps of:

providing a connector body having a grommet with a surface, the surface having at least one topmost cavity formed therein, the topmost cavity having a through-hole positioned therein, and the through-hole extending through the grommet; and forming a sealing membrane in the topmost cavity such that the sealing membrane substantially fills the topmost cavity but does not pass through the through-hole, wherein the sealing membrane has a viscosity of about 30,000 to 40,000 cps.

* * * * *